US009309892B2

(12) United States Patent
Tollner

(10) Patent No.: US 9,309,892 B2
(45) Date of Patent: Apr. 12, 2016

(54) VACUUM PUMP

(75) Inventor: Martin Ernst Tollner, Eastbourne (GB)

(73) Assignee: Edwards Limited, Crawley, West Sussex (GB)

( * ) Notice: Subject to any disclaimer, the term of this patent is extended or adjusted under 35 U.S.C. 154(b) by 998 days.

(21) Appl. No.: 13/500,210

(22) PCT Filed: Sep. 9, 2010

(86) PCT No.: PCT/GB2010/051506
§ 371 (c)(1),
(2), (4) Date: Apr. 4, 2012

(87) PCT Pub. No.: WO2011/048396
PCT Pub. Date: Apr. 28, 2011

(65) Prior Publication Data

US 2012/0201696 A1 Aug. 9, 2012

(30) Foreign Application Priority Data

Oct. 19, 2009 (GB) ..... 0918233.8

(51) Int. Cl.
*F04D 19/04* (2006.01)

(52) U.S. Cl.
CPC ..... *F04D 19/042* (2013.01); *F04D 19/044* (2013.01); *F04D 19/046* (2013.01)

(58) Field of Classification Search
CPC ... F04D 19/042; F04D 19/044; F04D 19/046; F04D 17/168; F04D 19/04; F01D 1/36; F16C 2360/45
See application file for complete search history.

(56) References Cited

U.S. PATENT DOCUMENTS 5,695,316 A * 12/1997 Schutz et al. ..... 415/90
5,707,213 A 1/1998 Conrad
5,893,702 A 4/1999 Conrad et al.

(Continued)

FOREIGN PATENT DOCUMENTS

EP 1068456 A1 8/2000
EP 1807627 A2 5/2006

(Continued)

OTHER PUBLICATIONS

Examination Report dated Feb. 2, 2015 for corresponding British Application No. GB0918233.8.

(Continued)

*Primary Examiner* — Ninh H Nguyen
*Assistant Examiner* — Christopher R Legendre
(74) *Attorney, Agent, or Firm* — Westman, Champlin & Koehler, P.A.

(57) ABSTRACT

The present invention provides a vacuum pump (10) which comprises a turbo-molecular pumping mechanism (12) in series with a Siegbahn pumping mechanism (14). A first pump inlet (16) is provided through which gas can pass through both the turbo-molecular pumping mechanism and the Siegbahn pumping mechanism. Additionally, an inter-stage (inlet 18) is provided through which gas can enter the pump at a location between the turbo-molecular pumping mechanism and the Siegbahn pumping mechanism and pass only through the Siegbahn pumping mechanism. There are flow channels (52, 62) in a first plurality of stages (32, 34) of the Siegbahn pumping mechanism which are in fluid communication with the inter-stage inlet (18) and gas entering the pump through the inter-stage inlet is pumped in parallel along said flow channels.

6 Claims, 3 Drawing Sheets

(56) References Cited

U.S. PATENT DOCUMENTS

| | | | | |
|---|---|---|---|---|
| 6,019,581 | A | 2/2000 | von Schulz-Hausmann et al. | |
| 6,030,189 | A * | 2/2000 | Bohm | F04D 19/04 415/90 |
| 6,193,461 | B1 * | 2/2001 | Hablanian | 415/90 |
| 6,709,228 | B2 * | 3/2004 | Stuart | 415/90 |
| 7,850,434 | B2 * | 12/2010 | Stones | 417/250 |
| 8,235,678 | B2 * | 8/2012 | Stones | 417/203 |
| 8,662,841 | B2 * | 3/2014 | Tollner et al. | 415/229 |
| 2006/0034702 | A1 | 2/2006 | Bohm | |
| 2008/0193303 | A1 | 8/2008 | Stones | |
| 2011/0286864 | A1 * | 11/2011 | Stones | 417/244 |
| 2012/0201696 | A1 * | 8/2012 | Tollner | 417/199.1 |

FOREIGN PATENT DOCUMENTS

| | | | |
|---|---|---|---|
| EP | 1807627 | A3 | 5/2006 |
| JP | 2003129990 | A | 5/2003 |
| JP | 2005030209 | A | 2/2005 |
| JP | 2007538197 | A | 12/2007 |
| WO | 9425760 | A1 | 11/1994 |
| WO | 9425760 | A2 | 12/1997 |
| WO | 2008035113 | A1 | 3/2008 |
| WO | WO 2008035113 | A1 * | 3/2008 ..... F04D 17/16 |

OTHER PUBLICATIONS

Prosecution history of corresponding Japanese Application No. 2012-533689 including: Notification of Reason for Rejection dated Jun. 19, 2014.

Second Office Action dated Dec. 12, 2014 for corresponding Chinese Application No. 201080057905.2.

Response dated Dec. 10, 2012 from corresponding European Application No. 10757819.7-2315.

U.K. Search Report dated Feb. 8, 2010 for corresponding British Application No. GB0918233.8.

PCT International Search Report dated Dec. 8, 2010 for corresponding PCT Application No. PCT/GB2010/051506, filed Sep. 9, 2010.

PCT International Written Opinion dated Dec. 8, 2010 for corresponding PCT Application No. PCT/GB20101051506, filed Sep. 9, 2010.

Examination Report dated Jun. 24, 2015 for corresponding British Application No. GB0918233.8.

Response dated Jul. 29, 2015 for corresponding Japanese Application No. 2012-533689.

* cited by examiner

VACUUM PUMP

The present invention relates to a vacuum pump, and in particular, a compound vacuum pump.

A known compound vacuum pump comprises a turbo-molecular pumping mechanism connected in series with a molecular drag pumping mechanism, the latter of which is typically a Holweck pumping mechanism. The mechanisms are driven by the same motor.

Molecular drag pumping mechanisms operate on the general principle that, at low pressures, gas molecules striking a fast moving surface can be given a velocity component from the moving surface. As a result, the molecules tend to take up the same direction of motion as the surface against which they strike, which urges the molecules through the pump and produces a relatively higher pressure in the vicinity of the pump exhaust.

These pumping mechanisms generally comprise a rotor and a stator provided with one or more helical or spiral channels opposing the rotor. Types of molecular drag pumping mechanisms include a Holweck pumping mechanism comprising two co-axial cylinders of different diameters defining a helical gas path therebetween by means of a helical thread located on either the inner surface of the outer cylinder or on the outer surface of the inner cylinder, and a Siegbahn pumping mechanism comprising a rotating disk opposing a disk-like stator defining spiral channels that extend from the outer periphery of the stator towards the centre of the stator. Another example of a molecular drag pumping mechanism is a Gaede mechanism, whereby gas is pumped around concentric channels arranged in either a radial or axial plane. In this case, gas is transferred from stage to stage by means of crossing points between the channels and tight clearance 'stripper' segments between the adjacent inlet and outlet of each stage. Siegbahn and Holweck pumping mechanisms do not require crossing points or tight clearance 'stripper' segments because their inlets and outlets are disposed along the channel length.

For manufacturing purposes the Siegbahn pumping mechanism may be preferred to the Holweck and Gaede pumping mechanisms. However, in the application of molecular drag mechanisms to a vacuum pump, the Holweck pumping mechanism is often considered as providing a higher level of performance at low power.

For a given rotor-stator clearance, the Siegbahn pumping mechanism typically requires more pumping stages to achieve the same levels of compression and pumping speed as the Holweck pumping mechanism. In addition, vacuum pumps which traditionally employ such pumping mechanisms are often able to control tighter clearances in a radial direction (preferential to a Holweck pumping mechanism) than in an axial direction (preferential to a Siegbahn pumping mechanism), further enforcing the need for more pumping stages to achieve the same level of performance. The addition of pumping stages leads to higher levels of power consumption. It is for this reason that turbomolecular pump manufacturers have tended towards the use of Holweck pumping mechanisms in preference to Siegbahn pumping mechanisms.

Typically, a vacuum pump is required to pump from a single inlet of the pump to an outlet of the pump. In other applications, it may be required or preferable for a vacuum pump to have the capability to pump from more than one inlet at different pressures. An example of such an application is a mass spectrometer system where the vacuum pump differentially pumps a plurality of vacuum chambers connected in series. A main pump inlet is connected to a low pressure vacuum chamber and an inter-stage inlet is connected to a higher pressure chamber. Gas entering the main inlet can usually pass through all of the pumping stages of the pump whereas gas entering through the inter-stage inlet can pass only through the pumping stages down stream of the inter-stage inlet. This arrangement allows pumping at different pressures by a single vacuum pump.

It is becoming an increasing customer requirement that vacuum pumps are able to deliver increased pumping capacity (or speed) in addition to gas compression. For example in mass spectrometer systems increased pumping speed allows greater throughput of the substance to be tested and therefore improved overall efficiency. Increased pumping capacity is required at both the main pump inlet and at the or each inter-stage inlet.

As discussed above a Holweck pumping mechanism provides greater pumping capacity and therefore it has been the choice of vacuum pump providers to provide a vacuum pump with a turbo-molecular pumping mechanism in series with a Holweck pumping mechanism and an inter-stage inlet between the turbo-molecular pumping mechanism and the Holweck pumping mechanism. It is not seen as desirable to combine a turbo-molecular pumping mechanism in series with a Siegbahn pumping mechanism because a Siegbahn pumping mechanism delivers lower pumping capacity and the capacity that can be achieved at the inter-stage inlet is limited by the pumping capacity of the Siegbahn mechanism.

The present invention seeks to provide an improved solution to inter-stage pumping.

The present invention provides a compound vacuum pump comprising:

a turbo-molecular pumping mechanism in series with a Siegbahn pumping mechanism;

a first pump inlet through which gas can pass through both the turbo-molecular pumping mechanism and the Siegbahn pumping mechanism; and an inter-stage inlet through which gas can enter the pump at a location between the turbo-molecular pumping mechanism and the Siegbahn pumping mechanism and pass only through the Siegbahn pumping mechanism;

wherein flow channels in a first plurality of stages of the Siegbahn pumping mechanism are in fluid communication with the inter-stage inlet and gas entering the pump through the inter-stage inlet is pumped in parallel along said flow channels.

Other preferred and/or optional aspects of the invention are defined in the accompanying claims.

In order that the present invention may be well understood, an embodiment thereof, which is given by way of example only, will now be described with reference to the accompanying drawings, in which.

Figure 1:
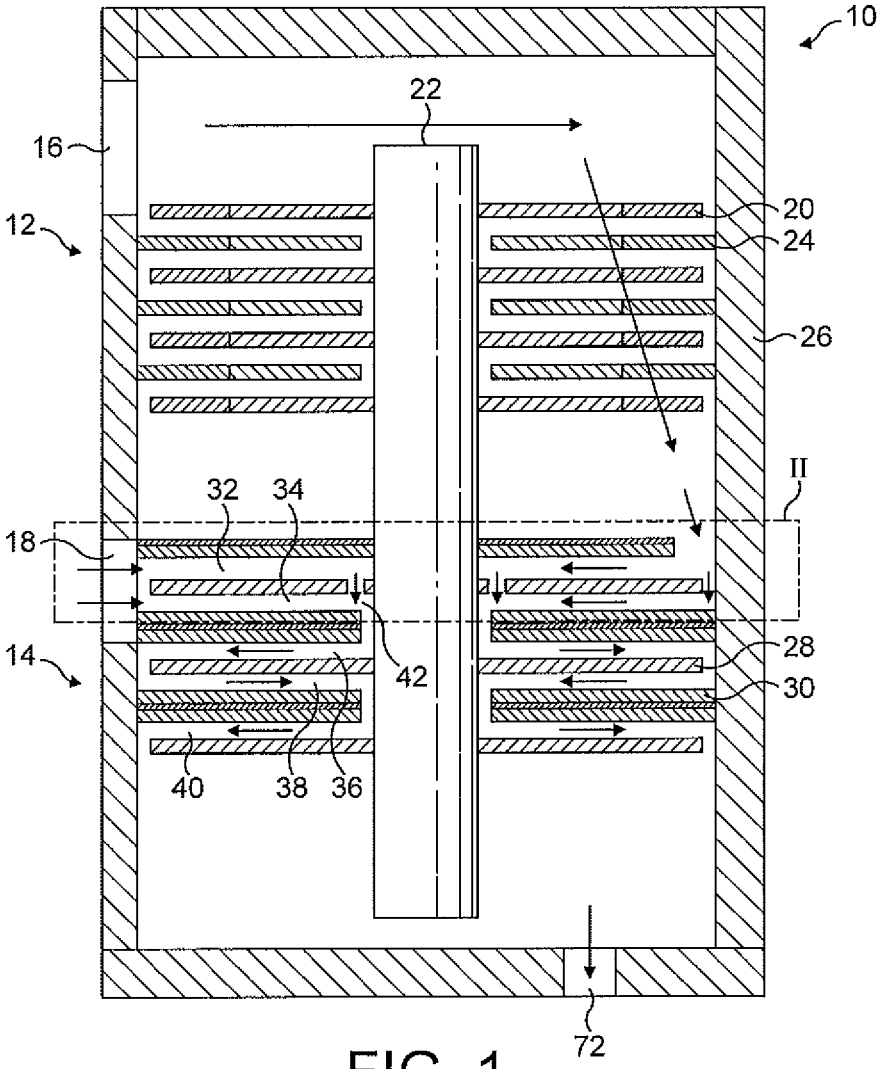
FIG. 1 shows schematically a vacuum pump embodying the present invention.

A compound vacuum pump 10 is shown in FIG. 1. The pump comprises a single housing and a turbo-molecular pumping mechanism 12 in series with a Siegbahn pumping mechanism 14. Gas entering the pump through a first, or main, pump inlet 16 can pass through both the turbo-molecular pumping mechanism 12 and the Siegbahn pumping mechanism 14. Gas entering the pump through an inter-stage inlet 18 at a location between the turbo-molecular pumping mechanism 12 and the Siegbahn pumping mechanism 14 can pass only through the Siegbahn pumping mechanism.

The turbo-molecular pumping mechanism 12 comprises a plurality of pumping stages each comprising an array of rotor blades 20 mounted on or integral with drive shaft 22 and an array of stator blades 24 fixed relative to pump housing 26. Four pumping stages are shown in this example. The structure and operation of a turbo-molecular pump are well known and will not be described further herein.

The Siegbahn pumping mechanism 14 comprises a plurality of pumping stages each comprising rotor and stator formations. As described in more detail below, typically in each stage the rotor comprises a disk 28 which is mounted on or integral with the drive shaft 22 and the stator comprises a disk 30 fixed relative to pump housing 26 and in which a plurality of spiral flow channels are formed. Siegbahn mechanism 14 comprises five such pumping stages 32, 34, 36, 38, 40 as shown in FIG. 1.

The flow channels in the first and second stages 32, 34 of the Siegbahn pumping mechanism are in fluid communication with the inter-stage inlet 18 and gas entering the pump through the inter-stage inlet is pumped in parallel along said flow channels. These flow channels converge at location 42 and continue along the same flow path through pumping stages 36, 38, 40. The provision of parallel pumping channels at the inter-stage inlet increases the pumping capacity of the Siegbahn pumping mechanism, since in the example two pumping channels pump at the inter-stage inlet rather than only one pumping channel in previously known Siegbahn arrangements. Additionally, since Siegbahn pumping mechanisms are more readily and more cost effectively manufactured in comparison with Holweck pumping mechanisms, the present vacuum pump offers a lower cost pump than in prior art designs.

In addition to pumping the inter-stage inlet 18, the Siegbahn pumping mechanism 14 also backs the turbo-molecular pumping mechanism 12. As shown gas exhausted from the final stage of the turbo-molecular pumping mechanism is pumped in parallel by the first and second pumping stages 32, 34 of the Siegbahn pumping mechanism. The turbo-molecular pumping mechanism has an operative range at which it can exhaust whilst effectively maintaining pressure at the main inlet. If the pressure at the inter-stage inlet 18 is within that operative range, the inter-stage pressure will not significantly affect operation of the turbo-molecular pumping mechanism. However, if the pressure at the inter-stage inlet is outside of the operative range, it will affect operation of the turbo-molecular pumping mechanism, particularly if the inter-stage inlet pressure is significantly higher than the operative range. Whilst the present invention is applicable in both such circumstances, the vacuum pump shown in the drawings has the capability of pumping at inter-stage inlet pressures which are higher than the operative range without significantly affecting operation of the turbo-molecular pumping mechanism. In this regard, the first and second stages of the Siegbahn pumping mechanism each comprise a plurality of spiral flow channels. One or more of the spiral flow channels in each stage are configured for pumping the inter-stage inlet and one or more spiral flow channels are configured for pumping the exhaust of the turbo-molecular pumping mechanism. In this way, the first and second stages of the Siegbahn pumping mechanism pump the inter-stage inlet and the exhaust of the turbo-molecular pumping mechanism in parallel along independent flow paths so that the pressure in one flow path can be different from the pressure in another flow path.

Figure 2:
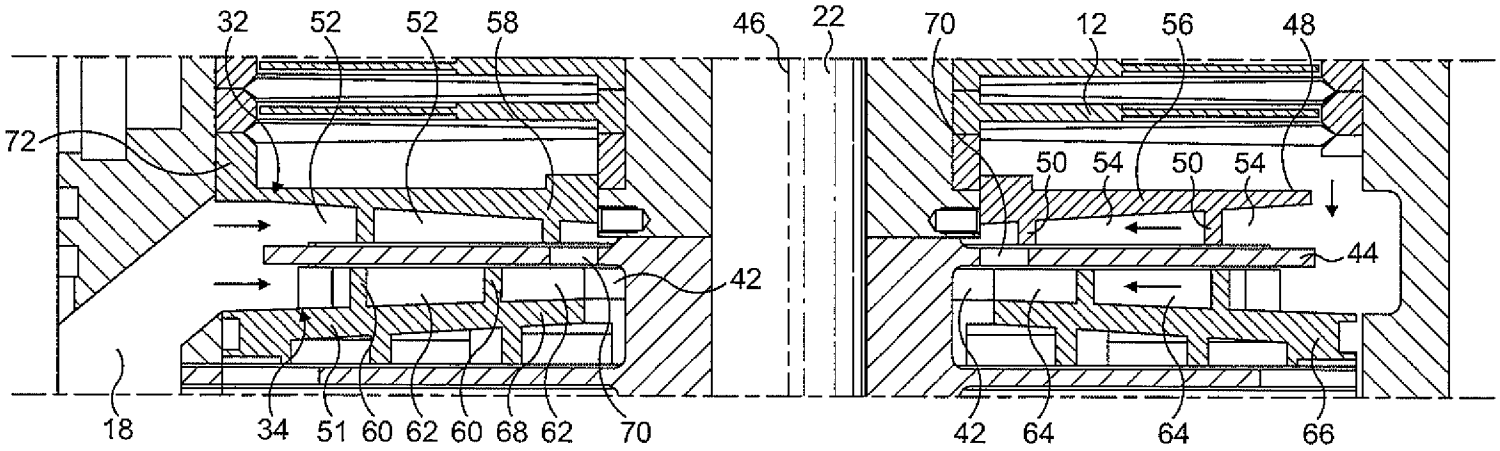
FIG. 2 shows in more detail the first and second stages of a Siegbahn pumping mechanism of the vacuum pump shown in FIG. 1.

The vacuum pump 10 and in particular the first 32 and second 34 stages of the Siegbahn pumping mechanism 14 will now be described in more detail with reference to FIGS. 2 and 3.

The first and second stages 32, 34 of the Siegbahn pumping mechanism comprise a rotor in the form of a single disk 44 mounted on, or integral with the drive shaft 22 rotatable about axis 46 by a motor (not shown). The generally planar surfaces on the upper and lower part of the rotor disk co-operate with respective stators 48, 51 forming first and second stages 32, 34. The first stator 48 comprises a plurality of walls 50 defining a first plurality of spiral flow channels 52 and a second plurality of spiral flow channels 54 within the stator 48 that generate a gas flow from the outer periphery 56 of the stator 48 towards the inner portion 58 of the stator 48. Similarly, second stator 51 comprises a plurality of walls 60 defining a first plurality of spiral flow channels 62 and a second plurality of spiral flow channels 64 within the stator 51 that generate a gas flow from the outer periphery 66 of the stator 51 towards the inner portion 68 of the stator 51.

Conversely, the spiral flow channels 52, 54, 62, 64 may be designed such that the pumping action is from the inner portions 58, 68 towards the outer periphery 56, 66 by reversing the relative angle of the channels or the rotation direction of the shaft 22. It is also possible to reverse the rotating and stationary features, such that the plain disc is stationary and the spiral flow channels form part of the rotating component. However, in the present vacuum pump 10 it is more practical to pump from a radial outer location to a radially inner location since the inter-stage inlet 18 is normally at a radially outer location.

Figure 3:
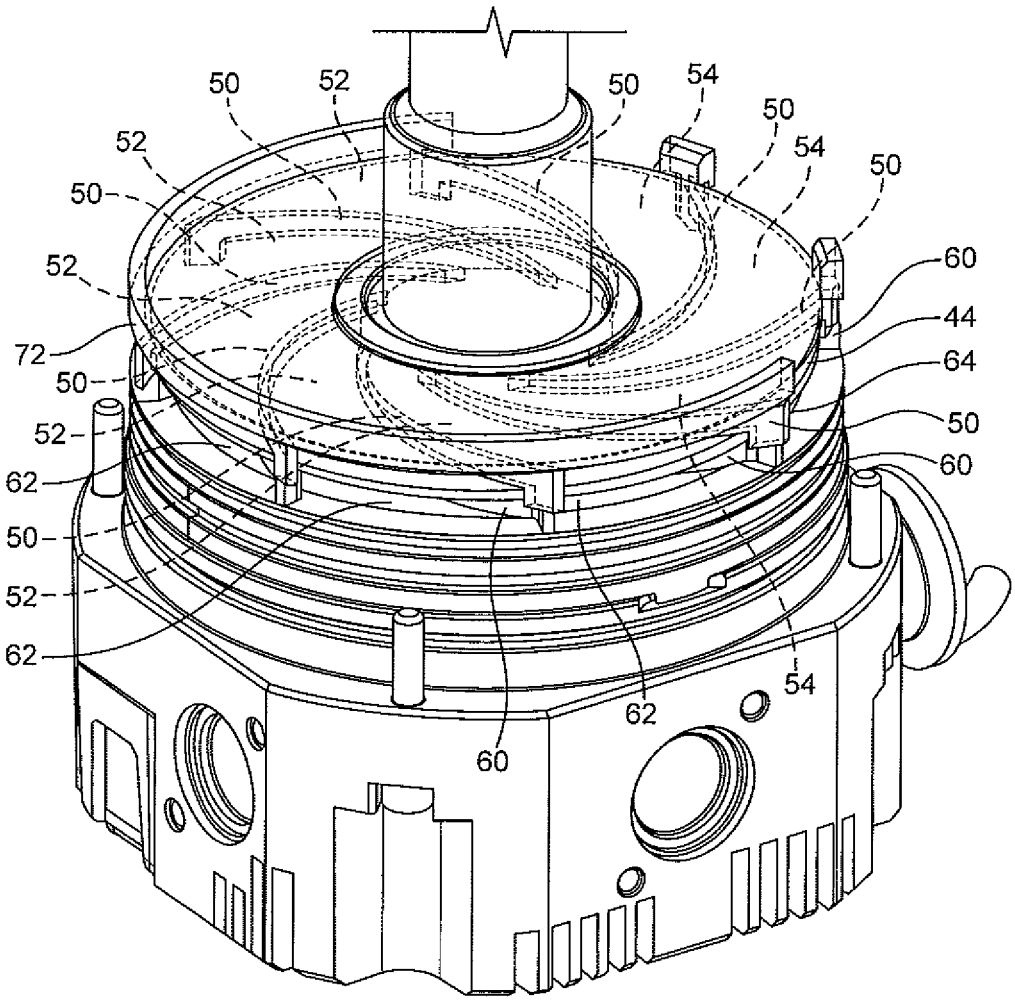
FIG. 3 shows the Seigbahn pumping mechanism shown in FIG. 2.

FIG. 3 is a perspective view of the Seigbahn section 14 showing in broken lines the walls of the stator 48 of the first pumping stage 32. The first stage 32 of the Siegbahn mechanism is above the rotor disk 44 and the second stage 34 is partially obscured and below the rotor disk. The outer peripheral regions of the flow channels 52 are in gas communication with the inter-stage inlet 18 and the outer peripheral regions of the flow channels 54 are in gas communication with the exhaust of the turbo-molecular pumping mechanism 14 Likewise, the outer peripheral regions of the flow channels 62 are in gas communication with the inter-stage inlet 18 and the outer peripheral regions of the flow channels 64 are in gas communication with the exhaust of the turbo-molecular pumping mechanism 14. Therefore, vacuum pump 10 can pump the inter-stage inlet 18 and the exhaust of the turbo-molecular pumping mechanism 14 in parallel along independent flow paths so that the pressure in one flow path can be different from the pressure in another flow path. The number of spiral flow channels connected to the inter-stage inlet 18 and the exhaust of the turbo-molecular pumping mechanism can be selected as required. For example there may be one or more spiral channels 52 connected to the inter-stage inlet 18 and one or more spiral flow channels 54 connected to the exhaust of the turbo-molecular pumping mechanism.

A baffle 72 in the form of an arcuate flange extends upwardly from an outer radial portion of the stator 48 of the first stage of the Seigbahn mechanism. As shown, the baffle extends through approximately 240° around the stator 48. As shown in FIG. 2, the baffle 72 abuts against an inner surface of the pump housing and acts as a barrier to the flow of gas from the exhaust of the turbo-molecular pumping mechanism to the inter-stage inlet 18. The baffle 72 does not extend fully about the circumference of the stator 48 thereby forming an inlet to allow gas from the exhaust of the turbo-molecular pumping mechanism to enter the Seigbahn pumping mechanism along flow channels 54, 64.

In use, the motor rotates the drive shaft 22 and the rotor 44. Gas from the inter-stage inlet 18 enters the pump 10 and is pumped in parallel along spiral flow channels 52, 62 in the first and second stages 32, 34 of the Siegbahn mechanism 14. Gas from the exhaust of the turbo-molecular pumping mechanism 14 enters the pump 10 and is pumped in parallel along spiral flow channels 54, 64. The rotor comprises a plurality of through bores 70 at a radially inner portion of the rotor disk 44 to allow gas pumped along spiral flow channels 52, 54 in the first stage 32 to pass therethrough to converge at location 42 with gas pumped along spiral flow channels 62, 64 in the second stage 34. As shown in FIG. 1, following convergence gas is pumped through pumping stages 36, 38, 40 and exhausted at pump exhaust 72.

The invention claimed is:

1. A vacuum pump comprising:

a turbo-molecular pumping mechanism in series with a Siegbahn pumping mechanism;

a first pump inlet through which gas can pass through both the turbo-molecular pumping mechanism and the Siegbahn pumping mechanism; and an inter-stage inlet through which gas can enter the pump at a position between the turbo-molecular pumping mechanism and the Siegbahn pumping mechanism and pass only through the Siegbahn pumping mechanism;

wherein each of a plurality of stages of the Siegbahn pumping mechanism have flow channels that lead from the inter-stage port to a location such that gas entering the pump through the inter-stage inlet is divided between the stages and the divided gas is pumped in parallel along said flow channels and converges at the location.

2. A vacuum pump as claimed in claim 1, wherein flow channels in first and second stages of the Siegbahn pumping mechanism are in fluid communication with the inter-stage inlet and gas entering the pump through the inter-stage inlet is divided between the first and second stages and the divided gas is pumped in parallel along said flow channels.

3. A vacuum pump as claimed in claim 1, wherein in use fluid is pumped along said flow channels from respective inlets thereto at a radially outer location proximate the inter-stage inlet to respective outlets at a radially inner location.

4. A vacuum pump comprising:

a turbo-molecular pumping mechanism in series with a Siegbahn pumping mechanism;

a first pump inlet through which gas can pass through both the turbo-molecular pumping mechanism and the Siegbahn pumping mechanism; and an inter-stage inlet through which gas can enter the pump at a location between the turbo-molecular pumping mechanism and the Siegbahn pumping mechanism and pass only through the Siegbahn pumping mechanism;

wherein flow channels in a plurality of stages of the Siegbahn pumping mechanism are in fluid communication with the inter-stage inlet and gas entering the pump through the inter-stage inlet is pumped in parallel along said flow channels and wherein the inter-stage inlet and the exhaust of the turbo-molecular pumping mechanism are pumped independently by the Siegbahn pumping mechanism at different pressures.

5. A vacuum pump as claimed in claim 4, wherein at least one of the flow channels in a first stage of the Siegbahn pumping mechanism is configured for pumping the inter-stage inlet and at least one of the flow channels in the first stage is configured for pumping the exhaust of the turbo-molecular pumping mechanism.

6. A vacuum pump as claimed in claim 4, wherein at least one of the flow channels in each of the plurality of stages of the Siegbahn pumping mechanism is configured for pumping the inter-stage inlet and at least one of the flow channels in each of the plurality of stages is configured for pumping the exhaust of the turbo-molecular pumping mechanism.

* * * * *